US005414212A

United States Patent [19]

Clouet et al.

[11] Patent Number: 5,414,212

[45] Date of Patent: May 9, 1995

[54] SHIELDED "HERRINGBONE" HARNESS

[75] Inventors: Pascal Clouet, Gregy sur Yerres; Francois Vaille, Corbeil Essonnes; André Viaud, Crosne, all of France

[73] Assignee: Filotex, Draveil, France

[21] Appl. No.: 9,997

[22] Filed: Jan. 27, 1993

[30] Foreign Application Priority Data

Jan. 29, 1992 [FR] France ..... 92 00951

[51] Int. Cl.[6] ..... H01B 7/34

[52] U.S. Cl. ..... 174/36

[58] Field of Search ..... 174/36, 103, 71 C, 72 A, 174/74 A; 434/607-610

[56] References Cited

U.S. PATENT DOCUMENTS

| | | | |
|---|---|---|---|
| 2,910,524 | 10/1959 | Schaffhauser | 174/26 R |
| 3,594,691 | 7/1971 | Neal | 174/78 X |
| 3,984,622 | 10/1976 | Ross | 174/72 A |
| 4,467,002 | 8/1984 | Crofts | 428/36 |
| 4,523,648 | 6/1985 | Strada et al. | 174/26 R |
| 4,731,500 | 3/1988 | Otsuka | 174/36 |
| 4,822,956 | 4/1989 | Sepe | 174/103 |
| 4,906,199 | 3/1990 | Twomey et al. | 439/95 |
| 5,012,045 | 4/1991 | Sato | 174/106 R |
| 5,091,604 | 2/1992 | Kirma | 174/2 |
| 5,102,351 | 4/1992 | Meshel | 439/607 |
| 5,105,054 | 4/1992 | Kirma | 174/2 |
| 5,295,868 | 3/1994 | Viaud | 439/610 |
| 5,349,133 | 9/1994 | Rogers | 174/36 |

FOREIGN PATENT DOCUMENTS

| | | |
|---|---|---|
| 0396932 | 11/1990 | European Pat. Off. . |
| 2520548 | 7/1983 | France . |

*Primary Examiner*—Leo P. Picard
*Assistant Examiner*—Christopher Horgan
*Attorney, Agent, or Firm*—Sughrue, Mion, Zinn, Macpeak & Seas

[57] ABSTRACT

The herringbone harness has multiple branches leading off from a trunk divided into segments by the forks at which the branches start. The harness is exclusively shielded firstly by first braids made over the individual branches, each first braid having a first enlarged tab over at least one of the segments on either side of the branch in question, and secondly by second braids made over the individual segments, each second braid having a second enlarged tab over that adjacent segment which is of smaller diameter than the segment in question. The application is a shielded harness serving multiple points from a common point of origin.

14 Claims, 3 Drawing Sheets

SHIELDED "HERRINGBONE" HARNESS

The present invention relates to shielded harnesses having a specific layout and referred to as "herringbone" harnesses.

BACKGROUND OF THE INVENTION

This type of harness is used to serve a plurality of different destinations from a common point referred to as the "point of origin". Such a harness is used in particular for supplying power and/or data/dialog to the various members of a system from the point of origin. The harness has a network of conductors co-operating together to define both a trunk starting from the point of origin and various branches leading off from the trunk. The branches correspond to the different destinations, and they are connected to the different members of the system. They define forks along the trunk, and may in turn have bifurcations for the purposes of connecting them to the various members.

The structure of this type of harness is such that it has a trunk and thin branches leading off from the trunk, the diameter of the trunk being large where it starts from the point of origin, and decreasing going away from the point of origin at each branch. The forks at which the branches lead off from the trunk define successive segments therealong, the end segment at the opposite end from the point of origin forming the last branch of the harness.

The ratio between the diameters of the two end segments is often high, and frequently greater than 20. The branches may in turn have different numbers of conductors from one another, and therefore have different diameters. Their diameters are much smaller than the diameters of the respective segments from which they start.

In a good many applications, such harnesses need to have high-performance protection against electromagnetic interference, and need to be strong enough to withstand considerable shocks, vibrations, and heat and/or chemical attack, in particular. This is particularly important when they are used in land, air, or sea mobiles.

Independently from the problem of providing high-performance electromagnetic protection, the use of braiding is known for covering a network of conductors, mainly to provide cohesion therefor or to improve the overall strength thereof. Such braiding leaves the network relatively easy to handle so as to facilitate laying it and inserting it to the various points at which its branches are connected in the mobile in which it is used.

The overall-strength braiding is often a textile fabric, or is sometimes made of metal. In general, it provides the network with good mechanical properties, but cannot per se directly provide high electromagnetic protection, in particular at the forks.

To obtain high electromagnetic protection for the harness, two possible techniques are known for shielding the substantially linear portions, and for providing continuity in the protection at the forks.

A first one of those techniques consists in using segments of cable which correspond to the segments and to the branches of the network, and which are initially independent and shielded individually by means of metal braiding, and in connecting them together by means of shielded splice boxes. The network is thus made up at the same time as the forks are shielded, by means of the splice boxes.

The shielded network obtained by using the first technique offers excellent electromagnetic performance levels, due both to the uniformity of the initial shielded segments of cable, and to the low transfer impedance due to the splice boxes. The network also has generally satisfactory mechanical properties. However, it is heavy, expensive, bulky, complex, and inflexible, due to it being made up from shielded cables which are different from one other, and from splice boxes which are also different from one another.

The second technique consists in using a network of conductors defining the harness directly, in shielding the branches and the various segments of the trunk by means of metal shielding braids made previously and threaded over each of them, and in threading heat-shrinkable metal-plated sleeves over the various forks to provide continuity in the shielding with the above-mentioned braids.

The shielded harness made by using the second technique is lighter in weight, less expensive, more compact, simpler, and more flexible than the harness made by using the first technique. However, with the second technique, the electromagnetic performance levels of the harness are poor and often insufficient, as are its mechanical properties, in particular its ability to withstand vibration which, as a result, reduces the electromagnetic protection provided.

The shielding method used in the second technique is difficult to perform, and even almost impossible when the herringbone harness has a large number of branches, and therefore has very large ratios between the diameters of the different segments, or between the diameters of the segments closest to the point of origin and the corresponding branches.

Furthermore, independently from the electromagnetic shielding of the network of conductors, and from the continuity in shielding over the forks, those two techniques require end connectors to be connected subsequently to the harness, at the ends of the various branches, and at the known common point of origin, and electromagnetic protection to be provided at the rear connection ends of the connectors. Mounting and electromagnetically protecting the connectors involves handling the shielding braids of the branches and of the starting trunk roughly, so as to thread them over the rear end of each corresponding connector, and then to lock them thereon.

Such rough handling irretrievably degrades the shape of the braids, and does not enable satisfactory continuity in shielding to be obtained between the connectors and the network of conductors, at least for some uses of the harnesses.

An object of the present invention is to avoid the drawbacks of those known techniques, so as to provide a shielded "herringbone" harness having high electromagnetic performance levels and high mechanical strength.

SUMMARY OF THE INVENTION

The invention therefore provides a shielded "herringbone" harness including a network of conductors all starting from a common point referred to as the "point of origin" and forming a trunk together with multiple branches along the trunk, thereby delimiting forks from the trunk at the starts of the branches, and segments of trunk between the forks, the diameter of the segments decreasing at each fork from the trunk, said harness further including shielding assemblies for shielding the trunk, the branches and the forks, wherein said shielding assemblies are constituted exclusively by shielding braids for shielding the branches and the trunk, and said shielding braids include firstly at least one first braid made over the length of each individual branch in question, with a first enlarged tab being made on the fork at the start of the branch and over an adjoining portion of at least one of the segments on either side of the fork, and secondly at least one second braid made substantially over the length of each individual segment, and, except for each second braid of the "end" segment which is the segment of smallest diameter, with a second enlarged tab being made over the end portion of the adjacent segment of smaller diameter, and covering the end of each second braid over the adjoining end portion of the adjacent segment as well as the first enlarged tab of each first braid of the branch at the start between the adjacent segments in question.

The shielded harness of the present invention further has at least one of the following additional features:

the second enlarged tab of the outermost "final" second braid of each segment forms a self-locking hem at the start of the final second braid;

the number of braiding wires and the braiding pitch of each braid are adapted to the diameter of the branch or of the segment that the braid covers, each enlarged tab having the same number of braiding wires as the braid to which it belongs, and having a braiding pitch which is either equal to the braiding pitch of that braid or adapted to the diameter of the portion of the harness over which it extends;

the harness includes protective strips, each being disposed between the second enlarged tab of the second braid of one of the segments and the end that the tab covers of the second braid of the adjacent segment of smaller diameter;

the harness further includes a preliminary lagging braid on each fork, in particular when the ratio between the diameter of the branch leading off from the fork and the diameter of either of the segments on either side is high;

some or all of the branches are equipped with individual "harness-integrated" end connectors, a "rear" branch-connection portion of each connector for connecting the connector to the branch being covered by each first braid of the branch, which first braid is made directly over the rear portion; and the branches not equipped with an end connector are pre-equipped with an expander of cross-sectional dimensions that are the same as those of a "rear" connection portion of the connector to be connected to the branch in question, the expander being mounted on the branch at the location of the connector to be connected, and being covered by the first braid of the branch, which first braid is made directly on the expander and is preformed thereover to the dimensions thereof.

BRIEF DESCRIPTION OF THE DRAWINGS

The characteristics and advantages of the present invention will appear on reading the following description of an embodiment given with reference to the accompanying drawings, in which.

MORE DETAILED DESCRIPTION

Figure 4:
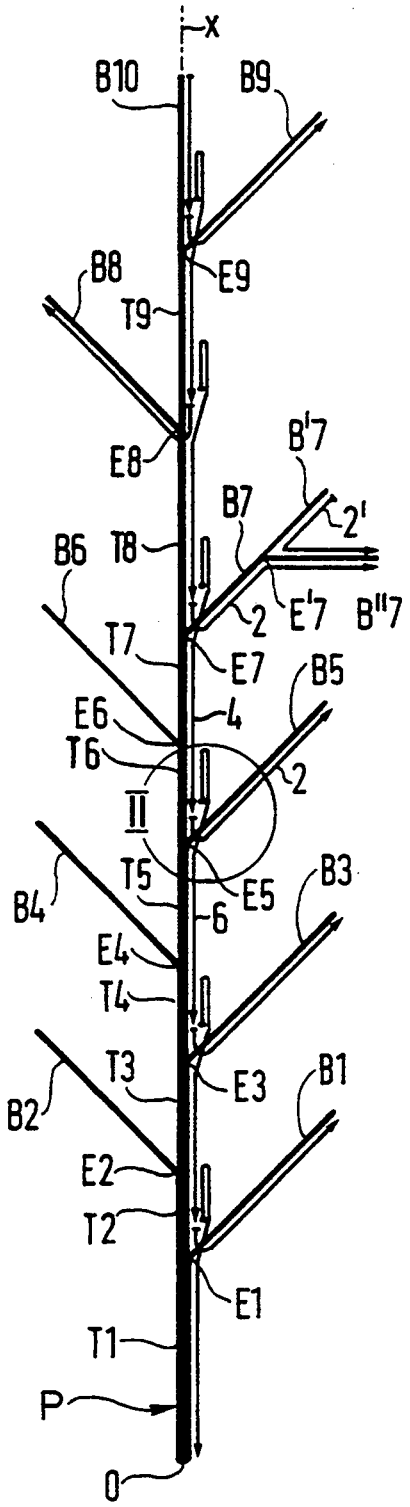
FIG. 4 is a highly simplified diagram showing a shielded harness of the present invention.

An overall view of the shielded harness of the present invention is shown in FIG. 4. The harness is referred to as a "herringbone" harness due to its specific layout. It comprises a network of twisted-together insulated conductors directly defining the herringbone shape of the harness, as shown in FIGS. 1 and 2, in particular.

As shown in FIG. 4, in this type of harness, the conductors all start from the same common point referred to as the "point of origin" O. They form a main trunk P starting from the point of origin, and multiple branches B leading off from the trunk and disposed therealong, referenced B1 to B10 going from the point of origin. The conductors define successive forks E1 to E9 along the trunk at the starts of the individual branches, and successive corresponding segments of trunk T1 to T9 along the trunk P, between the forks.

Each branch leads off from the trunk at a respective fork, as expressed by the reference system: the letters B for the branch, E for its fork, and T for the relevant segment are all followed by the same numeral. The end segment of the trunk, opposite from the point of origin, forms the last branch B10 of the harness directly.

Along the harness, the successive segments have different diameters, with the diameters decreasing from the point of origin at each fork, and the branches are thin. The end segment, or the last branch B10, has the smallest diameter of the harness.

Each branch has a plurality of twisted-together conductors and may in turn have one or more bifurcations, as shown on branch B7 which is divided into two secondary branches B'7 and B''7 at the secondary fork or bifurcation E'7.

The herringbone harness is shielded exclusively by metal shielding braids. The braids are made methodically firstly over the individual branches, and then over the individual segments starting from the segment of smallest diameter, with the exception of the end segment, or last branch, which may be considered to be a branch. The shielding braids for shielding the branches are referred to as "first" braids, and those used for shielding the segments are referred to as "second" braids. This method of shielding is described in detail with reference to FIGS. 1A to 1G.

Figure 1A:
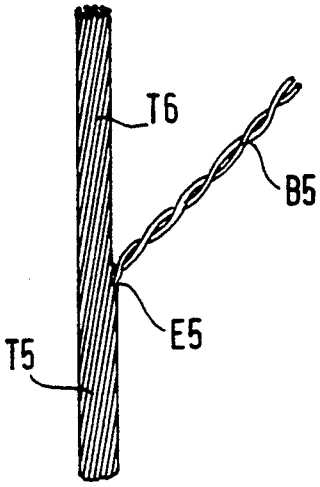
FIGS. 1A to 1G show the steps of the present invention by means of which a "herringbone" harness is electromagnetically shielded, only one portion of the harness being shown at one of the forks at which a branch starts.
Figure 2:
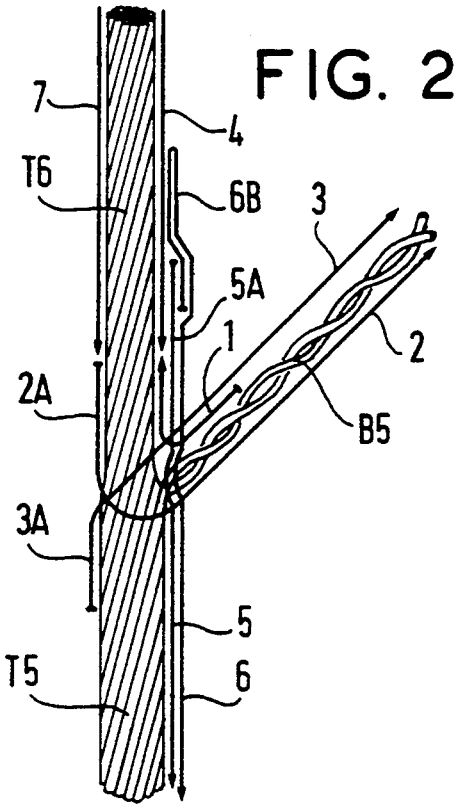
FIG. 2 is a diagram corresponding to FIGS. 1A to 1G and showing the same portion of the shielded harness of the invention.

FIG. 1A shows a portion of the harness prior to shielding at a single fork E5 (as referenced in FIG. 4). The upstream segment, i.e. the segment nearer the point of origin, and the following segment, which segments are on either side of the fork E5, are referenced T5 and T6 (as in FIG. 4). The branch leading off from the trunk between the two segments is branch B5. At this initial stage, the herringbone harness is bare.

Figure 1B:
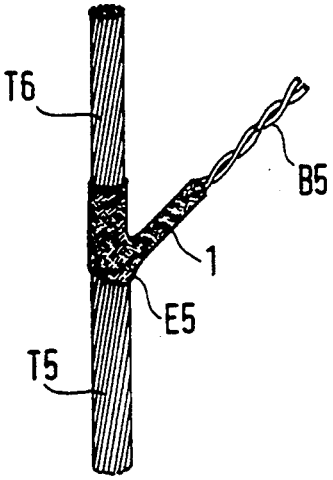

FIG. 1B shows a preferable but not essential preliminary treatment step for treating the fork E5. This step is highly desirable when the diameter of the branch is very different from the diameter of either one of the segments on either side of the fork. The preliminary treatment consists in making a lagging braid 1 over the fork E5, over the adjoining portion or start of the branch B5, and over the adjoining portion of one of the two segments, preferably the segment having the smaller diameter of the two, i.e. segment T6. The lagging braid filaments may be textile threads, but are preferably metal wires.

Figure 1C:
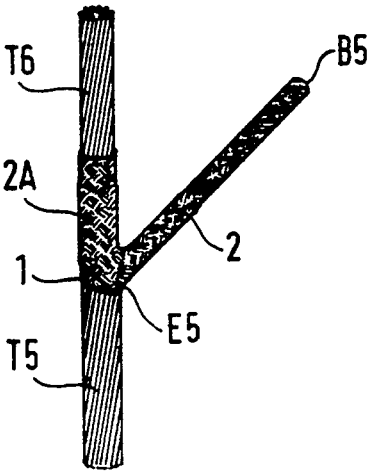
Figure 1D:
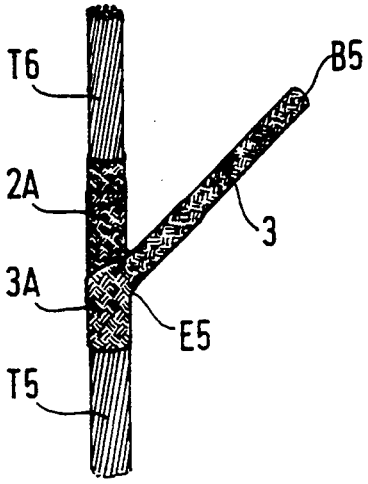

FIGS. 1C and 1D show the branch B5 being shielded, shielding being performed in two successive steps, in this example, by means of an initial first braid 2, and of a final first braid 3. The two first braids lie one on top of the other over the length of the branch. Each of them further has a respective enlarged tab 2A, 3A made on the fork and over the adjoining portion of a respective one of the two segments T5 and T6.

The enlarged tab 2A of the initial first braid 2 is made on the fork E5, over the adjoining portion of the following segment T6, and covering the lagging braid 1. The enlarged tab 3A of the final first braid is made on the fork E5 and over the adjoining portion of the upstream segment T5.

Each first shielding braid 2 or 3 is made directly over the branch and on the fork in question, and its enlarged tab 2A or 3A is made directly over the segment and on the fork in question. Each braid is made starting with the enlarged tab, and has a number of metal braiding wires and a braiding pitch that are adapted to the diameter of the branch for the purposes of shielding the branch, the enlarged tab preferably being made, however, with a pitch that is shorter and that is adapted to the diameter of the segment over which it extends, so as to enable proper shielding to be provided.

The first shielding braids 2 and 3 of the branch B5 constitute double-layer shielding. Naturally, the shielding of the branch may be single-layer and constituted by one of the first two braids, preferably by the initial first braid 2 only.

The different branches along the harness are shielded one after another, in analogous manner to branch B5, before the trunk is shielded. The trunk is shielded by treating the successive segments one after another starting from the one of smallest diameter.

Figure 1E:
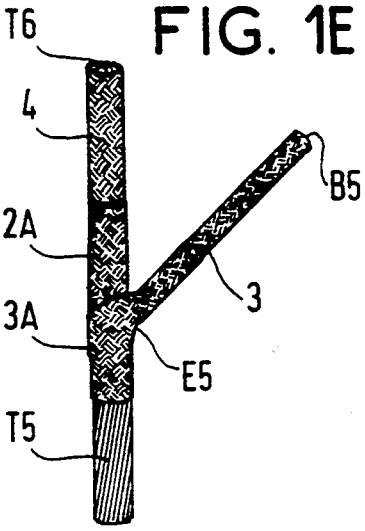
Figure 1F:
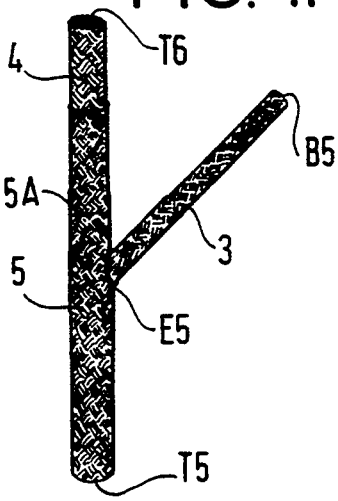
Figure 1G:
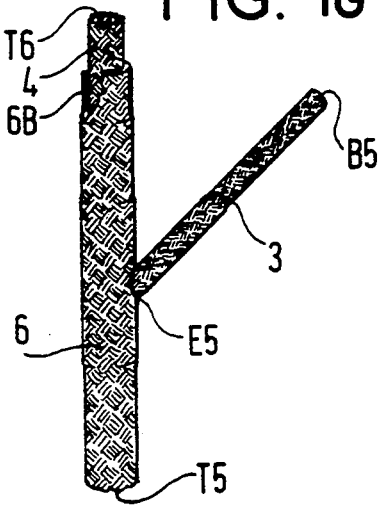

Each segment like segment T5 is shielded in two successive steps shown in FIGS. 1F and 1G. These steps follow the final shielding step (shown in FIG. 1E) during which the adjacent smaller-diameter segment, i.e. segment T6, is finally shielded.

In FIG. 1E, segment T6 is shown covered with a final second braid 4. At the end nearer the fork E5, the end of the final second braid either comes just to the end of the enlarged tab 2A of the first braid 2 (FIG. 1C), or may come beyond to cover the first braid, at least in part. The final second braid 4 of segment T6 is analogous to the final second braid of each of the other segments, and is specified with reference to FIG. 1G.

FIG. 1F, which corresponds to the initial shielding step during which segment T5 is shielded, shows the segment covered with an initial second shielding braid 5. The initial second braid is made over segment T5 and has an enlarged tab 5A over segment T6, which tab covers the end of the final second braid 4 of segment T6.

FIG. 1G, corresponding to the final shielding step during which segment T5 is shielded, shows that the final shielding step consists in making the final second braid 6 over the segment, with a specific enlarged tab referenced 6B over segment T5.

The enlarged tab 6B covers the enlarged tab 5A of the initial second braid (FIG. 1F) and also extends beyond for one or more centimeters over the final second braid 4 of the segment T6. To begin with, the enlarged tab of the final second braid is made with go-and-return braiding motion, by making a self-locking hem or loop at the start of the final second braid.

The second shielding braids 5 and 6 of the segment T5 constitute double-layer shielding. Naturally, this shielding may be single-layer, in which case it may be provided by the final second braid 6 only.

The succession of shielding operations during which the segments are shielded are conducted systematically, with the enlarged tab of each of the final second braids of the various segments covering and locking the end of the final second shielding braid made previously on the adjacent segment that is of smaller diameter than the segment in question. The locking enlarged tabs of the final second braids provide overall shielding continuity and strength for the trunk and its branches, whereby the shielding is made high-performance and comparable to continuous shielding made along a single cable.

Each of the second shielding braids is made in the same way as the first braids, with a number of braiding wires and a braiding pitch that are adapted to the diameter of the segment that the braid covers. Each enlarged tab of the second braids is made with the same number of wires as the second braid to which it belongs, but preferably with a different braiding pitch which may be smaller or larger than the pitch of the second braid, and which is adapted to the diameter, resulting from the preceding operations, of the portion that the enlarged tab covers.

FIG. 2 is a diagram showing the portion of the harness that has been shielded by means of the steps shown in FIGS. 1A to 1G. The same references as above are used for the lagging braid, the first shielding braids, and the second shielding braids. The various braids are shown in axial half-section over the twisted-together conductors defining segment T5, branch B5, and segment T6, each braid being represented by a single line, and therefore without thickness. The lines representing the axial half-sections of the various braids are situated on one or other side of the branch or of the segment in question to facilitate understanding, and for reasons of clarity.

A dash drawn across one end of the line representing each braid indicates the point at which braiding starts, and an arrow at the other end of the same braid indicates both the braiding direction and the point at which braiding stops.

FIG. 2 diagrammatically shows the initial first braid (referenced 7) of the segment T6.

The extra thickness created by the lagging braid 1 and by the enlarged tab 2A over segment T6 corresponds to the extra thickness due to the two second shielding braids 4 and 7 of the segment. The enlarged tabs 5A and 6B of the second braids 5 and 6 of the segment T5 form extra thickness over the end of segment T6, thereby merely making the end segment T6 have substantially the same diameter as the diameter of segment T5.

Figure 3:
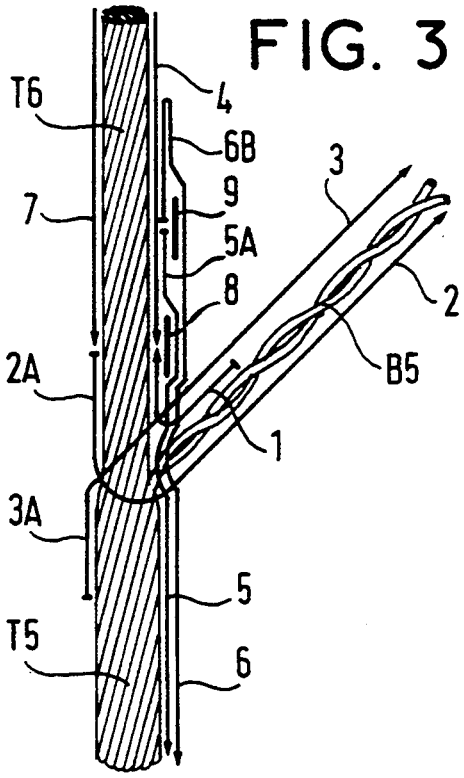
FIG. 3 is a variant given with respect to FIG. 2 and FIGS. 1A to 1G.

FIG. 3 corresponds to FIG. 2, with additional dispositions being provided at the ends of the braids which underlie the final second braid 6, and, where applicable, at the ends of the braids which underlie the initial second shielding braid 5.

The additional dispositions consist firstly of a first metal strip 8 surrounding the ends of the lagging braid 1, and of the second shielding braids 4 and 7, over segment T6, and secondly of a second metal strip 9 surrounding the end of the enlarged tab 5A of the initial second braid 5 of the segment T6.

Strip 8 is put in place before the initial second braid 5 is made, so that enlarged tab 5A covers the strip entirely. Strip 9 is put in place before the final second braid 6 is made, so that enlarged tab 6B covers the strip entirely. With respect to strip 9, as shown in this variant, it should be noted that the strip can also be mounted on the starting end of enlarged tab 6B, with the strip covering both said starting end of enlarged tab 6B and the end of enlarged tab 5A, when the two ends are end-to-end and are not overlapping, as they are in FIG. 2.

The strips provide protection for the shielding braids that they cover. They prevent the ends of the wires of the end portions underlying previously-made braids, which wire ends turn up naturally or have outwardly-projecting points, from piercing through the second shielding braids and through any additional insulating sheathing that may be provided on the harness.

The strips 8 and 9 are preferably self-adhesive so that they adhere to the ends of the braids that they cover, and remain properly in place, in particular when the respective enlarged tabs of the second shielding braids are being made over them.

FIG. 4 is a highly simplified diagram showing the shielding of the harness, only considering the branches to the right of the axis X on the trunk, and the branch B8 to the left of the axis, and ignoring the existence of branches B2, B4, and B6 for reasons of clarity. The shielding is represented as being single-layer on each branch considered, and on each segment, and the diagram identifies the first shielding braid 2 of branch B5, the second shielding braid 4 of segment T6, and the second shielding braid 6 of segment T5.

With reference to FIG. 4 and to branch B7 which splits into two secondary branches, there is a first additional shielding layer referenced 2′ made continuously over the two secondary branches B′7 and B″7, and over their additional fork E′7 before the first shielding braid (also referenced 2) of the branch is made.

The shielded harness of the invention is continuous in appearance, almost uniform, and without any roughness.

Figure 5:
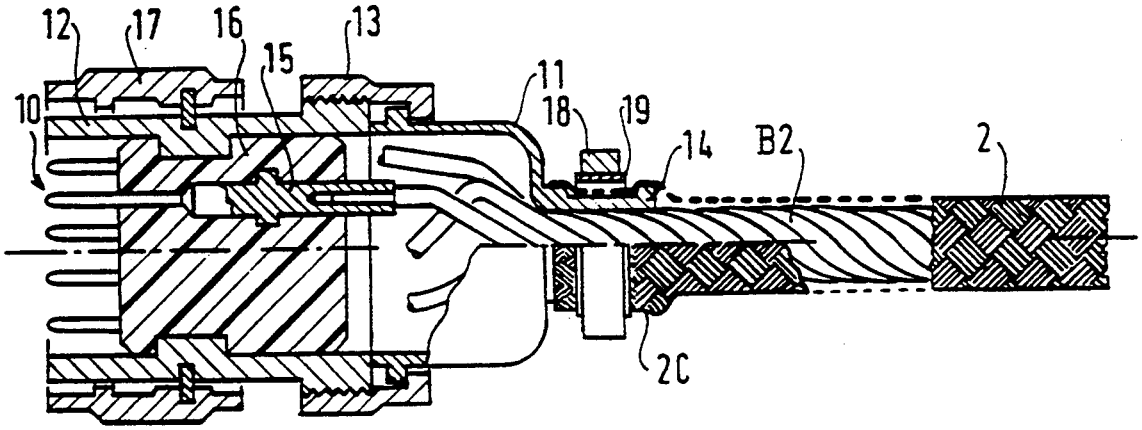
FIG. 5 is view partially in section of one of the branches of the FIG. 4 shielded harness, which branch is equipped with an "integrated" end connector.

FIG. 5 shows one of the branches of the shielded harness shown in FIG. 4, e.g. branch B2, which is equipped with an end connector 10.

In FIG. 5, the shielding braid of the branch is also referenced 2, is single-layer, and corresponds to the initial first braid of the above-mentioned branch B5.

The connector is known per se, but is integrated into the branch B2. It is connected to the end of the branch B2 before said branch is shielded.

The connector has a body made in two portions, namely a rear portion 11 and a front portion 12, which are assembled together by means of a link nut 13.

The rear portion delimits a chamber in which the twisted-together conductors making up the branch B2 are splayed out and distributed, the surplus length of the conductors optionally being cut off. The rear portion has a rear end which forms a rear collar 14 via which the conductors are inserted into the chamber.

The front portion 12 includes a plurality of contacts 15 mounted and retained in an insulating block 16, the conductors of the branch B2 being connected to the contacts. The contacts also project from the insulating block at the front face of the connector. A front peripheral nut 17 on the connector locks it to a complementary connector at the point at which the branch is connected.

The shielding braid 2 of the branch has an additional enlarged tab 2C made continuously therewith directly over the rear collar 14 of the connector 10 previously connected to the branch.

Enlarged tab 2C is subsequently locked onto the collar by suitable fixing means, such as a clamping ring 18, or a clamping clip, which is made of metal, which has shape memory, and which is shrinkable by means of cryogenics or magnetostriction. A protective flexible metal strip 19 may be interposed between the ring and enlarged tab 2C, over the ends of the wires in enlarged tab 2C, to avoid holes being pierced by the ends of the wires.

All the branches may be equipped with an integrated end connector in this way.

Figure 6:
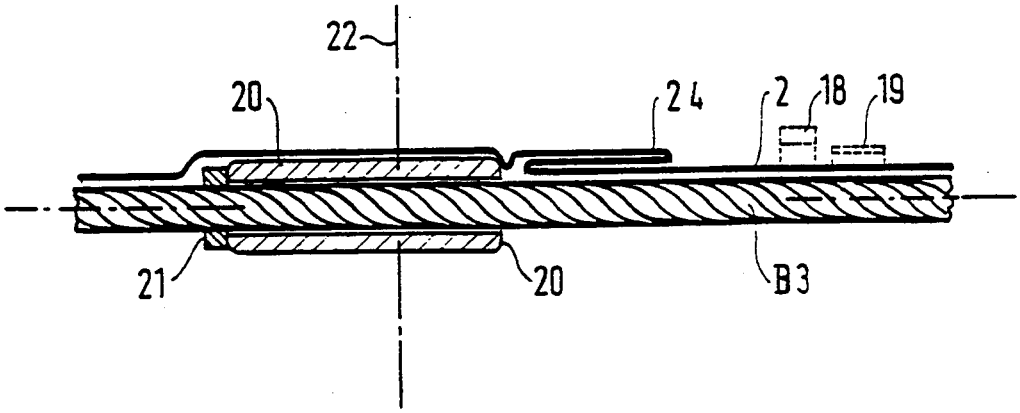
FIG. 6 is a variant on FIG. 5 and shows one of the branches of the FIG. 4 shielded harness, which branch is pre-equipped to enable an end connector to be subsequently mounted thereon.

FIG. 6 is a variant on FIG. 5, with respect to all of the various branches of the harness, or to some of the branches, e.g. branch B3. In this variant, branch B3 has no end connector, but it is pre-equipped with an expander 20 for the purposes of subsequently mounting the connector after the harness has been shielded.

The expander 20 is positioned at the location at which the connector is to be subsequently connected. The shielding braid (also referenced 2) is then made during the same braiding operations, with the expander being in place on the twisted-together conductors making up branch B3.

Advantageously, a positioner 21 is retained substantially at the ends of the twisted-together conductors of the branch. The positioner serves as a front abutment for the expander, which is then properly positioned, and prevents the expander from moving forwards or coming out from underneath the shielding braid both during the braiding operations and subsequently.

The cross-sectional dimensions of the expander are as close as possible to being the same as those of the rear end of the connector. The "rear" end 20A of the expander, which end is the innermost one along the branch, is shaped and has a rounded or conical shape. This shape ensures a smooth and gradual transition for the shielding braid between the expander and the bundle of twisted-together conductors, the expander and the bundle being of different cross-sectional dimensions.

The expander is made of a hard material, which may be metal or plastic.

The expander may be re-used many times, in particular when it has a complex shape, and is then relatively expensive.

The shielding braid 2 is made continuously over the length of the branch, which is already carrying the expander. The braid is thus preformed over the expander to the cross-sectional dimensions thereof, and therefore to the cross-sectional dimensions of the rear end of the connector. Braiding is performed with braiding pitches on the expander and on the bundle of conductors that are different, with a continuously varying pitch being possible at the transition, so that where applicable, and in particular when there is a large difference between the cross-sectional dimensions of the expander and those of the bundle, high-performance protection is obtained over the entire length of the branch, including the length over the expander.

The shielding braid 2 may either cover the entire expander, or only cover part of it.

Since the braid is preformed to the cross-sectional dimensions of the rear end of the connector, it avoids any rough handling that may degrade the characteristics of the braid when the connector is being installed.

The expander 20 further serves as an abutment surface for cutting the shielding braid 2 to the right length. The expander also protects the conductors it covers from being damaged when the braid is being cut. The plane on which the shielding braid is cut is referenced 22, and is situated at a distance from the rear end of the expander that is substantially equal to the length of the rear connection end of the connector. The braid is cut to enable the surplus length of braid to be removed, and the expander to be withdrawn, so that the rear end of the connector can be slid into place under the shielding braid without deforming it.

Advantageously, fixing and protection accessories are initially provided on the end portion pre-equipped ready for the connector to be installed, or they are mounted after the surplus length of shielding braid has been cut off and the expander has been removed. The fixing and protection accessories are shown by dashed lines and are given the same references as in FIG. 5. For example, the accessories comprise a shrinkable fixing ring 18 or an analogous component, a protective flexible metal strip 19, and also sheaths and sleeves made of a heat-shrinkable material, which sheaths and sleeves are used subsequently to provide transverse sealing for the resulting assembly.

Advantageously, the shielding braid 2 further includes a self-locking loop 24 made with the braid. The loop almost adjoins the rear end 20A of the expander, and extends, for in the range 1 centimeter to a few centimeters, over the bundle of twisted-together conductors defining the branch.

The loop is obtained by means of go-and-return braiding motion, while the braid is being made, so as to form a double hem.

The loop prevents the shielding braid from slipping on the conductors and/or prevents any multiple layers in the shielding braid from slipping on one another, in particular when the surplus length of the braid is being cut off, and the connector is being installed and connected. The loop acts directly as a fixing ring for fixing the shielding braid on the bundle of conductors. It also opposes any relative displacement of the shielding braid and of the bundle that may occur when they are mechanically urged by vibration under certain conditions of use, thereby avoiding any rubbing and resulting degradation of the conductor insulators.

We claim:

1. A shielded herringbone harness including a network of conductors all starting from a common point referred to as the point of origin and forming a trunk together with multiple branches along the trunk, thereby delimiting forks from the trunk at the starts of the branches, and segments of trunk between the forks, the diameter of the segments decreasing at each fork from the trunk, said harness further including shielding assemblies for shielding the trunk, the branches and the forks, wherein said shielding assemblies are constituted exclusively by shielding braids for shielding the branches and the trunk, and said shielding braids include firstly at least one first braid made over the length of each individual branch in question, with a first enlarged tab being made on the fork at the start of the branch and over an adjoining portion of at least one of the segments on either side of the fork, and secondly at least one second braid made substantially over the length of each individual segment, and, except for each second braid of the end segment which is the segment of smallest diameter, with a second enlarged tab being made over the end portion of the adjacent segment of smaller diameter, and covering the end of each second braid over the adjoining end portion of the adjacent segment as well as the first enlarged tab of each first braid of the branch at the start between the adjacent segments in question.

2. A shielded harness according to claim 1, wherein said second braids of the individual segments include an outer final second braid on each segment, said second enlarged tab of the final second braid forming an end self-locking hem at a first end of the final second braid of the segment in question and of the second end of the final second braid of the adjacent segment of smaller diameter.

3. A shielded harness according to claim 2, wherein the second braids of the individual segments are multilayer and include an initial second braid over each segment, said second enlarged tab of said initial second braid being substantially end-to-end with the second braids for shielding the adjacent segment of smaller diameter.

4. A shielded harness according to claim 1, wherein each of said second braids has a number of braiding wires and a braiding pitch that are adapted to the diameter of the segment in question, the second enlarged tab of the second braid having the same number of braiding wires as said second braid, but preferably having a braiding pitch adapted to the diameter of the end portion of the adjacent segment that it covers.

5. A shielded harness according to claim 1, wherein the first braids for shielding the individual branches include an initial first braid, said first enlarged tab of which is made on the smaller-diameter one of the two segments on either side of the fork at the start of the branch in question.

6. A shielded harness according to claim 1, wherein the first braids of the individual branches are multi-layer and include an initial first braid and a final first braid, the respective first enlarged tabs of which are made on respective ones of the two segments on either side of the fork at the start of the branch in question.

7. A shielded harness according to claim 5, wherein each of said first braids has a number of braiding wires and a braiding pitch that are adapted to the diameter of the branch in question, the first enlarged tab of the first braid having the same number of wires as said first braid but preferably having a braiding pitch that is shorter and that is adapted to the diameter of the portion of the segment that it covers.

8. A shielded harness according to claim 1, further including at least one lagging braid made over each fork and over the adjoining portions of the branch at the start of the fork and of at least the smaller-diameter one of the two segments on either side of the fork.

9. A shielded harness according to claim 1, in which at least one of the branches has at least one bifurcation from which the branch in question splits into secondary branches, wherein said harness includes additional first braids made over said secondary branches, with one of the additional first braids being made continuously over two of the secondary branches and their bifurcation, thereby ensuring continuity of shielding, and being at least partially covered by each first shielding braid for shielding the branch to which said secondary branches belong.

10. A shielded harness according to claim 1, further including at least one metal strip between said second enlarged tab of each second braid of one of said segments and the end which said second enlarged tab covers of each second braid of the adjacent segment of smaller diameter.

11. A shielded harness according to claim 1, having end connectors on at least some of said branches, a rear connection portion of each connector being connected to the conductors in the branch in question, wherein each of the first braids of the branches having terminal connectors further has an additional enlarged tab which is opposite from said first enlarged tab, which is made directly over the rear end of said connector, and which is locked on the rear end, thereby integrating the connector into said harness.

12. A shielded harness according to claim 1, further including an expander equipping each branch not initially connected to an end connector, which expander is of cross-sectional dimensions substantially identical to those of a rear connection portion of the connector for connecting the connector to the branch in question, is mounted on the branch substantially at the location of the connector to be connected to the branch, and is covered by each first braid of the branch, which braid is made directly on the expander and preformed thereover to the dimensions thereof.

13. A shielded harness according to claim 12, further including an end positioner associated with and mounted at the end of said expander substantially over the end of the conductors of the branch.

14. A shielded harness according to claim 12, wherein the outermost first braid of each branch equipped with an expander has a self-locking loop substantially adjoining that end of the expander which is situated closer to the fork at the start of the branch in question, and extending over a portion of the branch.

* * * * *